US012729472B2

(12) United States Patent
Hettinger et al.

(10) Patent No.: US 12,729,472 B2
(45) Date of Patent: Sep. 8, 2026

(54) LAUNDRY TREATMENT APPLIANCE AND WATER SAVING METHODS FOR LAUNDRY TREATMENT APPLIANCES

(71) Applicant: Haier US Appliance Solutions, Inc., Wilmington, DE (US)

(72) Inventors: Stephen Edward Hettinger, Louisville, KY (US); Nicholas Matthew Dillon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 108 days.

(21) Appl. No.: 18/635,254

(22) Filed: Apr. 15, 2024

(65) Prior Publication Data

US 2025/0320648 A1 Oct. 16, 2025

(51) Int. Cl.

| | |
|---|---|
| ***D06F 23/04*** | (2006.01) |
| ***D06F 33/34*** | (2020.01) |
| ***D06F 33/36*** | (2020.01) |
| ***D06F 33/37*** | (2020.01) |
| ***D06F 33/38*** | (2020.01) |
| ***D06F 33/42*** | (2020.01) |
| ***D06F 33/46*** | (2020.01) |
| ***D06F 34/22*** | (2020.01) |
| ***D06F 39/08*** | (2006.01) |
| *D06F 103/18* | (2020.01) |
| *D06F 103/20* | (2020.01) |
| *D06F 105/02* | (2020.01) |
| *D06F 105/08* | (2020.01) |
| *D06F 105/42* | (2020.01) |

(52) U.S. Cl.

CPC ..... *D06F 33/46* (2020.02); *D06F 23/04* (2013.01); *D06F 33/34* (2020.02); *D06F 33/36* (2020.02); *D06F 33/37* (2020.02); *D06F 33/38* (2020.02); *D06F 33/42* (2020.02); *D06F 34/22* (2020.02); *D06F 39/083* (2013.01); *D06F 39/085* (2013.01); *D06F 39/087* (2013.01); *D06F 2103/18* (2020.02); *D06F 2103/20* (2020.02); *D06F 2105/02* (2020.02); *D06F 2105/08* (2020.02); *D06F 2105/42* (2020.02)

(58) Field of Classification Search

None

See application file for complete search history.

(56) References Cited

U.S. PATENT DOCUMENTS

2012/0011659 A1 1/2012 Park

FOREIGN PATENT DOCUMENTS

| | | |
|---|---|---|
| CN | 108625101 A | 10/2018 |
| KR | 101603105 B1 | 3/2016 |

*Primary Examiner* — Levon J Shahinian

(74) *Attorney, Agent, or Firm* — Dority & Manning, P.A.

(57) ABSTRACT

A method of operating a laundry treatment appliance includes supplying a first predetermined volume of water to articles within a wash chamber; performing a first agitation phase after supplying the first predetermined volume of water to the articles; performing a first drain phase after performing the first agitation phase. The first drain phase includes draining a first predetermined portion of the first predetermined volume water such that a level fill volume of water remains within the wash tub. The method further includes supplying a second predetermined volume of water to the articles within the wash chamber, the second predetermined volume being less than the first predetermined volume, wherein the second predetermined volume and the level fill volume together define a rinse volume of water.

8 Claims, 4 Drawing Sheets

LAUNDRY TREATMENT APPLIANCE AND WATER SAVING METHODS FOR LAUNDRY TREATMENT APPLIANCES

FIELD OF THE INVENTION

The present subject matter relates generally to laundry treatment appliances, and more particularly to methods of conserving water in laundry operations.

BACKGROUND OF THE INVENTION

Washing machine appliances generally include a cabinet which supports a tub for containing wash fluid, e.g., water and detergent, bleach and/or other wash additives. A basket is mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

Many washing operations include supplying water to the drum or tub multiple times for agitation phases, rinse phases, and the like. Existing laundry treatment appliances exhibit drawbacks, however. For instance, excessive water usage is prevalent within current machines. Water supplied to the tub is drained multiple times per operation, leading to large quantities of water being used for a single operation.

Accordingly, a laundry treatment appliance that obviates one or more of the above-mentioned drawbacks would be beneficial. In particular, a method of operating a laundry treatment appliance that reduces water consumption would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet defining a receiving space; a wash tub provided within the receiving space; a wash basket received within the wash tub, the wash basket defining a wash chamber configured for receipt of articles for washing; and a controller provided within the cabinet, the controller being configured to direct a laundry operation. The laundry operation may include supplying a first predetermined volume of water to the articles within the wash chamber; performing a first agitation phase after supplying the first predetermined volume of water to the articles within the wash chamber; performing a first drain phase after performing the first agitation phase, wherein the first drain phase includes draining a first predetermined portion of the first predetermined volume water such that a level fill volume of water remains within the wash tub; and supplying a second predetermined volume of water to the articles within the wash chamber, the second predetermined volume being less than the first predetermined volume, wherein the second predetermined volume and the level fill volume together define a rinse volume of water.

In another exemplary aspect of the present disclosure, a method of operating a laundry treatment appliance is provided. The laundry treatment appliance may include a wash basket positioned within a tub, the wash basket defining a wash chamber for receipt of articles for washing. The method may include supplying a first predetermined volume of water to the articles within the wash chamber; performing a first agitation phase after supplying the first predetermined volume of water to the articles within the wash chamber; performing a first drain phase after performing the first agitation phase, wherein the first drain phase includes draining a first predetermined portion of the first predetermined volume water such that a level fill volume of water remains within the wash tub; and supplying a second predetermined volume of water to the articles within the wash chamber, the second predetermined volume being less than the first predetermined volume, wherein the second predetermined volume and the level fill volume together define a rinse volume of water.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
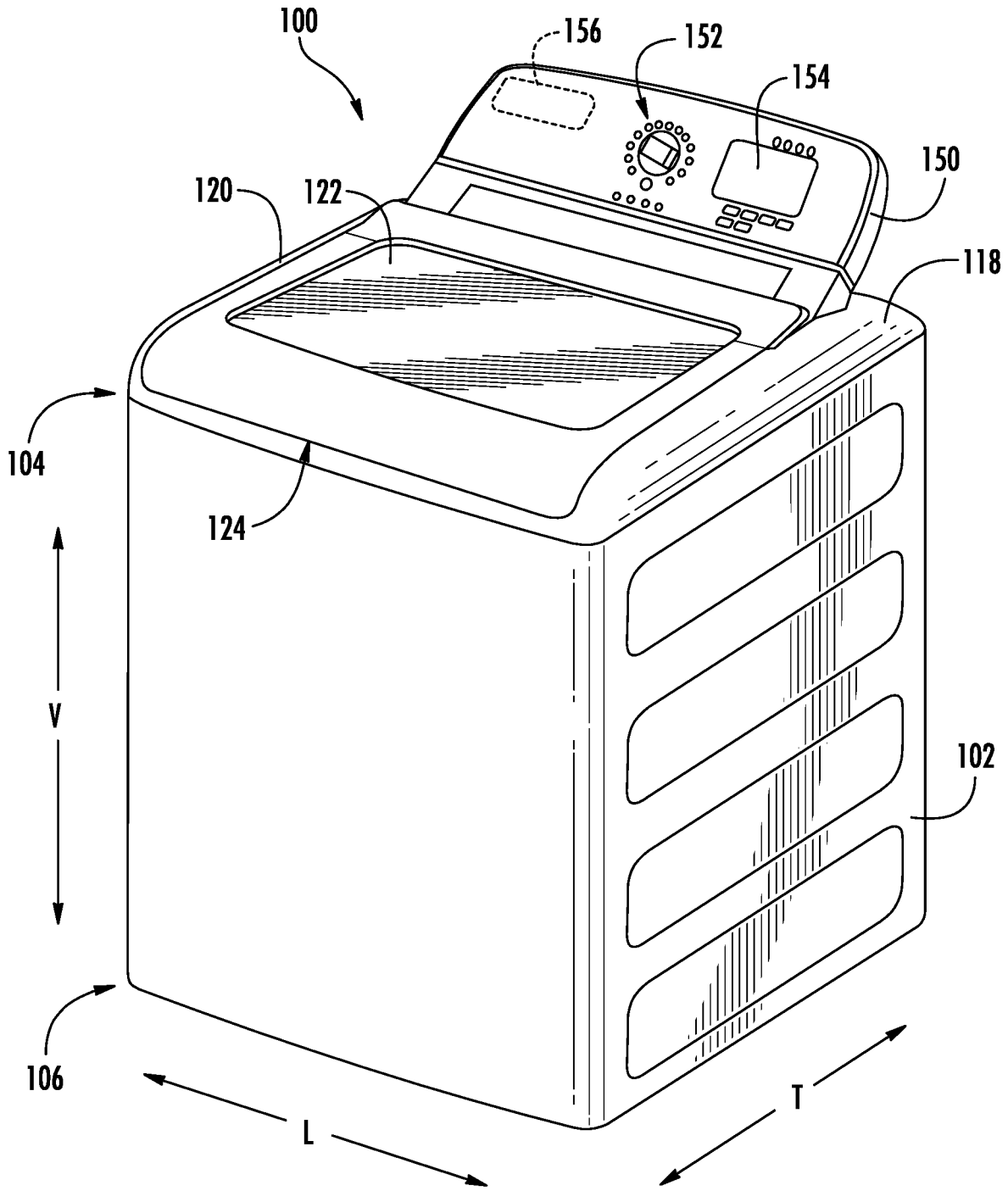
FIG. 1 provides a perspective view of a laundry machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
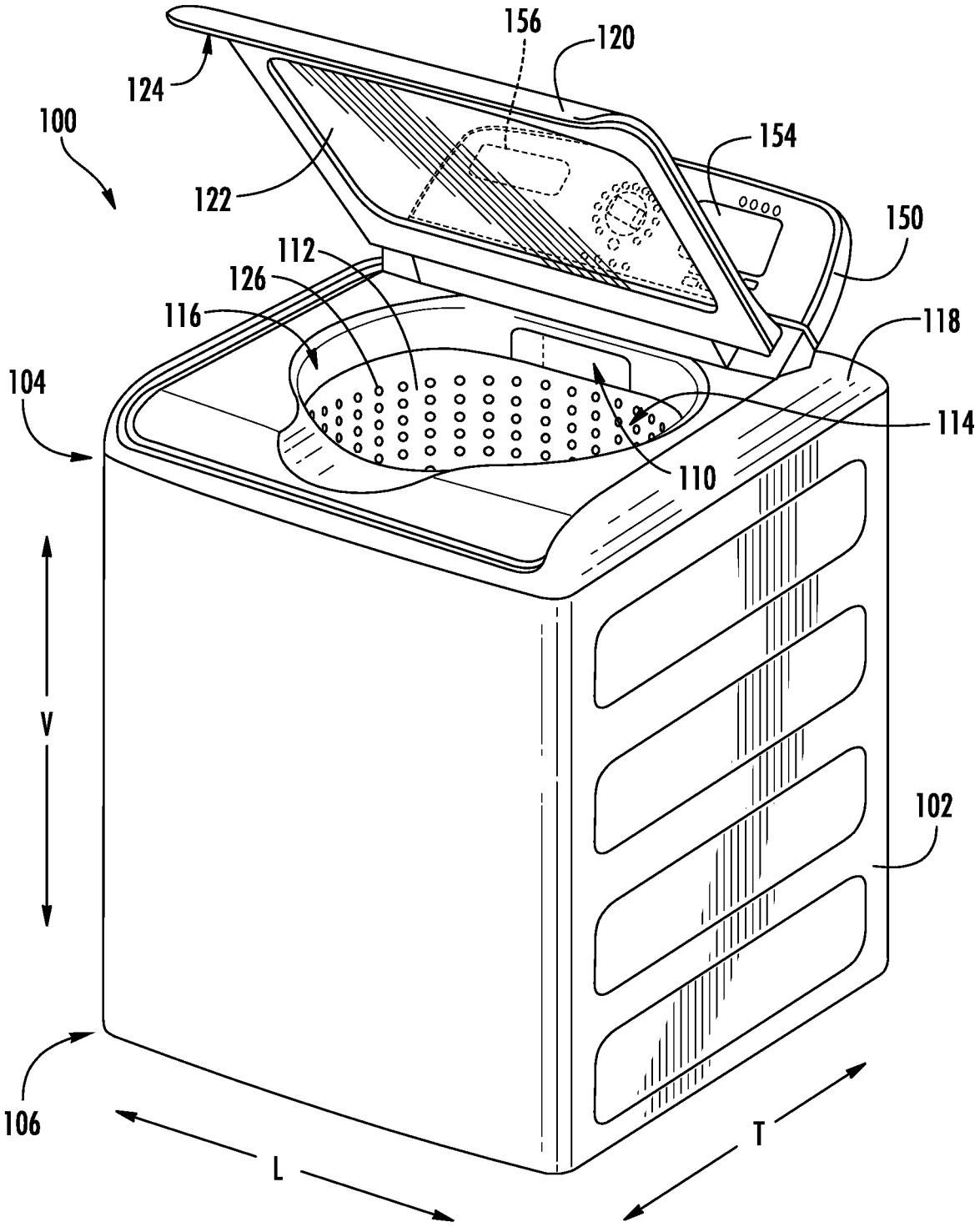
FIG. 2 provides a perspective view of the exemplary laundry machine appliance of FIG. 1 with the lid in an open position.
Figure 3:
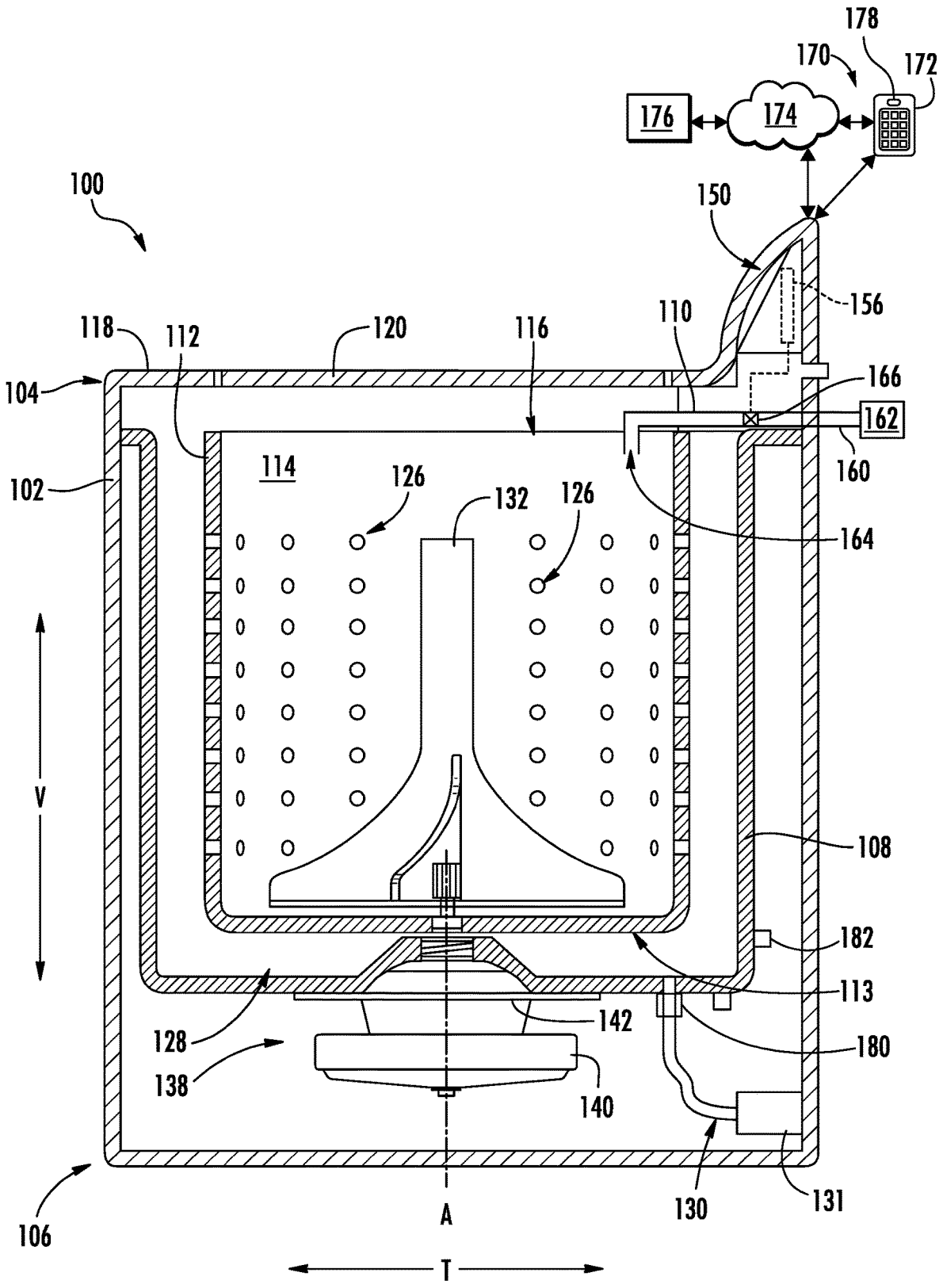
FIG. 3 provides a cut-away side view of the exemplary laundry machine appliance of FIG. 1.

FIGS. 1 through 3 illustrate an exemplary embodiment of a vertical axis laundry machine appliance or laundry treatment appliance (e.g., such as a washing machine) 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance, a stand-alone washing machine, a dryer, or any suitable appliance capable of performing a laundry operation on a laundry load.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments. Further, it should be noted that primary dispenser 110 is provided by way of example only, and that laundry machine appliance 100 may incorporate any suitable form of detergent dispenser, including manual fill dispensers.

In addition, laundry machine appliance 100 may include one or more wash baskets or drums 112 selectively positioned within tub 108 and generally defining one or more wash chambers 114. For instance, an opening 116 may be formed in cabinet 102 for receipt of articles for washing (e.g., for receipt of one or more removable wash baskets). More specifically, wash basket 112 (e.g., one or more) may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well. Additionally or alternatively, wash basket 112 may be at least partially spaced apart from tub 108. In detail, a bottom surface or under surface 113 of wash basket 112 may be spaced apart from a base of tub 108 (e.g., along the vertical direction V). As will be described, a sump 128 may thus be formed between bottom surface 113 and tub 108. A length, depth, or size of the gap between bottom surface 113 and tub 108 may vary according to specific embodiments of the present disclosure.

As illustrated, cabinet 102 of laundry machine appliance 100 has a top panel 118. Top panel 118 may define opening 116 of to permit a user access to tub 108. Laundry machine appliance 100 may further include a door 120 which is rotatably mounted to top panel 118 to permit selective access to opening 116. In particular, door 120 may selectively rotate between the closed position (as shown in FIGS. 1 and 3) and the open position (as shown in FIG. 2). In the closed position, door 120 inhibits access to tub 108 (and, selectively, one or more wash baskets 112). Conversely, in the open position, a user can access wash basket 112. A window 122 in door 120 may permit viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle. In some instances, laundry machine appliance includes a drain valve 180. Drain valve 180 may be positioned at or near a bottom of wash tub 108. For instance, drain valve may be in fluid communication between wash tub 108 and pump assembly 130. Drain valve 180 may be operably connected with a controller (described below). Thus, drain valve 180 may be selectively opened and closed to allow fluid to drain from wash tub 108. In some instances, drain valve 180 is incorporated with pump assembly 130. Further, according to some embodiments, pump assembly 130 may omit drain valve 180 and include only a drain pump 131.

An impeller or agitator 132 (FIG. 3), such as a vane agitator, impeller, auger, oscillatory basket mechanism, or some combination thereof may be disposed in wash basket 112 to impart an oscillatory motion to articles and liquid in wash basket 112. More specifically, agitator 132 may extend into wash basket and assists agitation of articles disposed within wash basket 112 during operation of laundry machine appliance 100, e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated.

As best illustrated in FIG. 3, laundry machine appliance 100 includes a drive assembly 138 in mechanical communication with wash basket 112 to selectively rotate wash basket 112 (e.g., during an agitation or a rinse cycle of laundry machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Laundry appliance 100 may include one or more sensors or means for determining a laundry load size provided within wash basket 112. According to one example, a laundry load size or weight may be determined by driving drive motor 140 at a predetermined speed and detecting a basket speed and load output of drive motor 140. For instance, obtaining the basket speed of the wash basket may include measuring a motor frequency, a back electromotive force (EMF) on the motor, or a motor shaft speed (e.g., using a tachometer). It should be appreciated that other systems and methods for monitoring motor power and/or basket speeds may be used while remaining within the scope of the present subject matter. Additionally or alternatively, laundry treatment appliance 100 may include one or more sensors 182 (e.g., pressure sensors, weight sensors, etc.) for detecting the amount of water and or clothes within wash tub 108. For example, sensor 182 may be operably coupled to a side of wash tub 108 for detecting the weight of wash tub 108. The controller may use the weight of wash tub 108 to determine a volume of water (e.g., in wash chamber 114) or an amount of water within wash tub 108 (e.g., within sump 128).

Referring to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 is controlled by a controller or processing device 156 that is communicatively coupled with control panel 150 for user manipulation to select washing machine cycles and features. In response to user manipulation of control panel 150, controller 156 operates the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses.

Referring to FIG. 3, laundry machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108.

Laundry appliance 100 may include a camera assembly configured to capture one or more images of an interior of wash basket 112. Controller 156 may be programmed or configured for analyzing the images obtained by the camera assembly, e.g., in order to determine the level or amount of a laundry load provided within wash chamber 114 or other cycle information, and may use this information to make informed decisions (e.g., regarding the operation of washing machine appliance 100 or regarding details of the laundry loads provided therein). For instance, the camera assembly may include one or more digital cameras capable of capturing still images, video images, or the like. The camera assembly may be attached to cabinet 102, door 120, or the like. As such, the camera may be provided within wash chamber 114, external to appliance 100, or any other suitable location.

Referring still to FIG. 3, a schematic diagram of an external communication system 170 will be described according to an exemplary embodiment of the present subject matter. In general, external communication system 170 is configured for permitting interaction, data transfer, and other communications between appliance 100 and one or more external devices. For example, this communication may be used to provide and receive operating parameters, user instructions or notifications, performance characteristics, user preferences, or any other suitable information for improved performance of appliance 100. In addition, it should be appreciated that external communication system 170 may be used to transfer data or other information to improve performance of one or more external devices or appliances and/or improve user interaction with such devices.

For example, external communication system 170 permits controller 156 of appliance 100 to communicate with a separate device (or multiple separate devices) external to appliance 100, referred to generally herein as an external device 172. For instance, multiple external devices 172 (e.g., a first mobile device belonging to a first user, a second mobile device belonging to a second user, etc.) may selectively communicate with appliance 100 via external communication system 170. As described in more detail below, these communications may be facilitated using a wired or wireless connection, such as via a network 174. In general, one or more external devices 172 may include any suitable devices separate from appliance 100 that are configured to provide and/or receive communications, information, data, or commands from a user or users. In this regard, external device 172 may be, for example, a personal phone, a smartphone, a tablet, a laptop or personal computer, a wearable device, a smart home system, or another mobile or remote device. Additionally or alternatively, external device 172 may include a camera 178. Camera 178 may be configured to capture one or more images (e.g., still images, video clips, burst images, etc.).

In addition, a remote server 176 may be in communication with appliance 100 and/or external device 172 through network 174. In this regard, for example, remote server 176 may be a cloud-based server, and thus may be located at a distant location, such as in a separate state, country, etc. According to an exemplary embodiment, external device 172 communicates with a remote server 176 over network 174, such as the Internet, to transmit/receive data or information, provide user inputs, receive user notifications or instructions, interact with or control appliance 100, etc. In addition, external device 172 and remote server 176 may communicate with appliance 100 to communicate similar information.

In general, communication between appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 4:
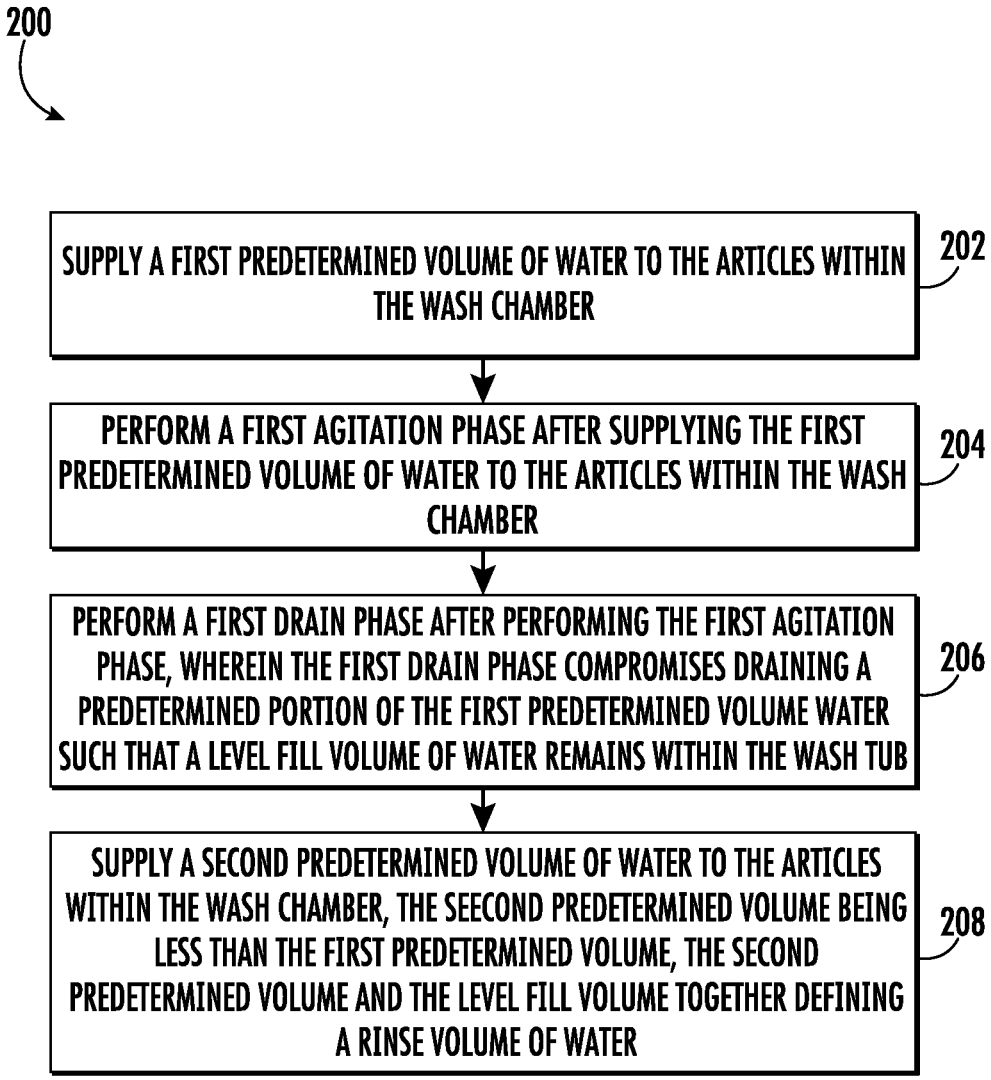
FIG. 4 provides a flow chart illustrating a method of operating a laundry machine appliance according to one or more embodiments.

FIG. 4 provides a flowchart illustrating a method 200 of operating a laundry machine (e.g., laundry machine 100) according to an exemplary embodiment of the present disclosure. FIG. 4 provides a non-exhaustive method of operation, and the method may include more or fewer steps than shown in FIG. 4, according to specific embodiments. Additionally or alternatively, the steps detailed in method 200 may be performed in any suitable order.

Method 200 may include determining a load size of the laundry load within the wash basket. One of a plurality of methods may be incorporated for determining the load size of the laundry load. For instance, the load size may be determined according to a power draw required for the motor to rotate the drum within the tub. For another example, a weight of the laundry load within the drum is determined according to one or more weight sensors. Additional or alternative methods may be incorporated for determining the load size of the laundry load. Accordingly, an appropriate or matching amount of detergent to be added may be determined according to the load size. For instance, method 200 may retrieve a corresponding detergent dispense amount based on the determined load size (e.g., from a lookup table). Additionally or alternatively, the corresponding detergent dispense amount may be calculated according to the load size.

At step 202, method 200 may include supplying a first predetermined volume of water to the articles within the wash chamber. In detail, after determining the load size of the laundry load, the first predetermined volume of water may be supplied to the wash chamber (e.g., to wet the articles of the laundry load). The first predetermined volume of water may be based on the load size of the laundry load. For instance, the first predetermined volume of water may be sufficient to thoroughly wet the articles within the wash chamber. Thus, the first predetermined volume of water may be less than a maximum volume of the wash chamber.

A detergent may be supplied to the wash chamber. For instance, before, concurrently with, or after the first predetermined volume of water is supplied to the wash chamber, a determined amount of detergent may be supplied. The detergent may be supplied to the wash chamber via an automatic dosing system. For one example, the determined amount of detergent is retrieved from a bulk detergent dispenser and supplied to the wash chamber along with the second predetermined volume of water. According to additional or alternative embodiments, the determined amount of detergent is supplied to the wash chamber from a detergent chamber, cup, assembly, or other known additive system provided within the appliance. Further still, the detergent may be added to the wash chamber manually (e.g., by a user).

At step 204, method 200 may include performing a first agitation phase after supplying the first predetermined volume of water to the articles within the wash chamber. In detail, the first agitation cycle may include the first predetermined volume of water and the detergent. The first agitation cycle may include one or more agitation motions or movements (e.g., a rotation of the drum, a rotation of the agitator, etc.). The first agitation cycle may be performed for a predetermined agitation time period (e.g., a predetermined first agitation time period). For instance, the predetermined agitation time period may be between about 10 minutes and about 20 minutes. However, it should be noted that the times provided herein are mentioned by way of example only, and that any suitable time period may be incorporated for the agitation time period.

At step 206, method 200 may include performing a first drain phase after performing the first agitation phase. The first drain phase may drain or otherwise release a predetermined portion or percentage (e.g., a first predetermined portion) of the first predetermined volume of water from the tub. For instance, only a portion (e.g., less than 100%) of the first predetermined volume of water may be drained from the tub such that a level fill volume of water remains in the tub. According to at least some embodiments, the level fill volume of water at least coincides with the sump. For instance, the level fill volume of water may coincide with a bottom surface of the wash basket. Accordingly, the level fill volume of water may be sufficient to fill the tub (e.g., the sump) up to the bottom of the wash basket. The level fill volume of water may thus be leftover water (or a water/detergent mixture) from the first predetermined volume of water. However, the level fill volume of water may vary according to specific embodiments of the present disclosure. For instance, the level fill volume of water may be sufficient to fill the tub (e.g., the sump) up to a lowest perforation in the wash basket.

As mentioned above, the laundry treatment appliance may include one or more features, methods, instruments, or sensors for determining a water level within the tub and/or wash chamber. Accordingly, while performing the first drain phase, method 200 may monitor (e.g., via weight, pressure, etc.) the amount of water within the system (e.g., within the sump). For one example, method 200 may determine that a total weight (or pressure) at a weight sensor (or pressure sensor) reaches a predetermined threshold. In detail, method 200 may activate the drain pump to initiate the first drain phase. As the water is draining, the weight or pressure of the system (e.g., the tub) may be monitored until the predetermined threshold is reached. The predetermined threshold may signify that the level fill volume of water has been reached within the sump. At this point, the first drain phase may conclude and the drain pump may be deactivated.

According to another example, method 200 may, at the initiation of the first drain phase, open the drain valve (or a valve within the drain pump). The drain valve may remain in the open (e.g., draining) position for a predetermined drain time. The predetermined drain time may be based on the first predetermined volume of water supplied to the articles for washing. For instance, when the first predetermined volume of water is larger such as with a larger laundry load or greater number of articles, the predetermined drain time may be greater than when the first predetermined volume of water is smaller such as with a smaller laundry load or fewer number of articles. Accordingly, the predetermined drain time may vary according to different washing operations, different wash load sizes, or the like. Additionally or alternatively, the predetermined drain time may signify that the level fill volume of water has been reached within the sump. At this point, the first drain phase may conclude and the drain valve may be closed.

At step 208, method 200 may include supplying a second predetermined volume of water to the articles within the wash chamber. The second predetermined volume of water may be less than the first predetermined volume of water. For instance, the second predetermined volume of water may be added to the level fill volume of water which remains in the sump. Collectively, the second predetermined volume of water and the level fill volume of water may define a rinse volume of water. According to at least some embodiments, the rinse volume of water may be approximately equal to the first volume of water. Advantageously, less water may be supplied or used for the second predetermined volume of water than the first predetermined volume of water, thus using less water overall for the washing operation.

According to some embodiments, a rinse agitation phase may be performed. In detail, after supplying the second predetermined volume of water to the articles within the wash chamber, method 200 may perform the rinse agitation phase. The rinse agitation phase may be similar to the first agitation phase. Additionally or alternatively, the rinse agitation phase may include one or more altered motions (e.g., rotations) within the wash basket or pertaining to an agitator.

According to some embodiments, method 200 may include performing a second drain phase after performing the rinse agitation phase. The second drain phase may be similar to the first drain phase. For instance, the second drain phase may drain or otherwise release a predetermined portion or percentage (e.g., a second predetermined portion) of the rinse volume of water from the tub. In some instances, the second predetermined portion is approximately equal to the first predetermined portion). For instance, only a portion (e.g., less than 100%) of the rinse volume of water may be drained from the tub such that the level fill volume of water remains in the tub. It should be noted that method 200 may include multiple executions of agitation phases, water supply phases, drain phases, spin phases, or the like. For instance, at each drain phase (excluding a final drain phase), the volume of water drained or released from the tub may be restricted such that the level fill volume of water remains in the tub (e.g., in the sump).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry treatment appliance, the laundry treatment appliance comprising a wash basket positioned within a tub, the wash basket defining a wash chamber for receipt of articles for washing, and a drain pump in fluid communication with the wash tub, the method comprising:

supplying a first predetermined volume of water to the articles within the wash chamber;

performing a first agitation phase after supplying the first predetermined volume of water to the articles within the wash chamber;

performing a first drain phase after performing the first agitation phase, wherein the first drain phase comprises draining a first predetermined portion of the first predetermined volume water such that a level fill volume of water remains within the wash tub, wherein performing the first drain phase comprises:

activating the drain pump; and deactivating the drain pump after an expiration of a predetermined drain time, wherein the predetermined drain time is based on the articles for washing; and supplying a second predetermined volume of water to the articles within the wash chamber, the second predetermined volume being less than the first predetermined volume, wherein the second predetermined volume and the level fill volume together define a rinse volume of water.

2. The method of claim 1, further comprising:

supplying a detergent to the wash chamber together with the first predetermined volume of water.

3. The method of claim 1, wherein the level fill volume of water coincides with a bottom surface of the wash basket.

4. The method of claim 1, further comprising:

performing a rinse agitation phase after supplying the second predetermined volume of water to the articles within the wash chamber.

5. The method of claim 4, further comprising:

performing a second drain phase after performing the rinse agitation phase, wherein the second drain phase comprises draining a second predetermined portion of the rinse volume water such that the level fill volume of water remains within the wash tub.

6. The method of claim 1, wherein the laundry treatment appliance further comprises:

a sensor operably coupled to the wash tub, the sensor being configured to sense one or more properties of the wash tub, the wash basket, and the articles for washing, the one or more properties comprising a water pressure within the tub.

7. The method of claim 6, wherein performing the first drain phase further comprises:

determining that a total water pressure at the sensor reaches a predetermined threshold after activating the drain pump; and deactivating the drain pump after determining that the total water pressure at the sensor reaches the predetermined threshold only if the total water pressure at the sensor reaches the predetermined threshold before the expiration of the predetermined drain time.

8. The method of claim 1, wherein the laundry treatment appliance is a top load vertical axis laundry appliance.

* * * * *